US005225612A

United States Patent [19]

Bernkrant

[11] Patent Number: 5,225,612

[45] Date of Patent: Jul. 6, 1993

[54] MAGAZINE GUN LOCK SAFETY

[76] Inventor: Keith Bernkrant, P.O. Box 3498 - Bright Station, Hialeah, Fla. 33013

[21] Appl. No.: 868,639

[22] Filed: Apr. 15, 1992

[51] Int. Cl.[5] ..... F41A 17/36

[52] U.S. Cl. ..... 42/70.02; 42/70.08

[58] Field of Search ..... 42/70.01, 70.02, 70.08; 89/137

[56] References Cited

U.S. PATENT DOCUMENTS

| | | | |
|---|---|---|---|
| 1,024,932 | 4/1912 | Haeghan | 42/70.02 |
| 1,183,115 | 5/1916 | Reising | 42/70.02 |
| 1,416,671 | 5/1922 | Artamendi | 42/70.02 |
| 1,486,497 | 3/1924 | Schmeisser | 42/70.02 |
| 1,638,063 | 8/1927 | Tansley | 42/70.02 |
| 2,115,041 | 4/1938 | Obregon | 42/70.02 |
| 2,372,519 | 3/1945 | Roper | 42/70.02 |
| 3,857,325 | 12/1974 | Thomas | 42/70.02 |
| 4,428,138 | 1/1984 | Seecamp | 42/70.02 |

*Primary Examiner*—Stephen C. Bentley

[57] ABSTRACT

An improved magazine gun lock safety for a semiautomatic handgun has a rectangular safety catch with a right angled OFF activating lever affixed on one side. When the magazine is removed from the gun magazine chamber, the safety catch which is pivotal angles over pushed by a biasing spring so the OFF lever protrudes through an opening into the empty magazine chamber. In this position, the safety is ON and interferers with the hammer spring guide. The gun hammer spring can not activate the trigger-hammer mechanism and the hammer is immobilized preventing the gun from being fired. If a live cartridge has remained undetected in the firing chamber, the gun cannot be fired accidentally. When the magazine is pushed back into the handgun magazine chamber, it forces the OFF activating lever back out of the handgun magazine chamber and the safety catch is in the OFF position releasing the hammer spring guide. The trigger-hammer mechanism is then operational and the gun can be fired.

4 Claims, 1 Drawing Sheet

MAGAZINE GUN LOCK SAFETY

BACKGROUND OF THE INVENTION

1. Field of the Invention

This invention relates to a safety lock for a semiautomatic handgun. The present invention is particularly directed towards a magazine gun lock safety which activates to ON when the magazine is removed from the gun handle. With the magazine removed from the gun handle, the trigger mechanism is deactivated and the gun can not be fired. When the magazine is reinserted into the gun handle, the safety is returned to a position of OFF, the gun trigger becomes operational, and the gun can be fired.

2. Description of the Prior Art

As can be seen in patents examined during a patent search, with the development of multiple bullet holding magazines and the automatic loading of handguns, a need was seen for a safety device to prevent inadvertent firing of the gun when the magazine was removed or partly removed from the gun handle. Illustrative of this need is U.S. Pat. No. 1,024,932, issued to G. V. Haeghen on Apr. 30, 1912. This early patent shows different mechanics for deactivating the trigger of an older autoloading handgun, one by removal of the magazine and one by rocking the barrel of the gun to set the safety. Other similar safety devices are also shown in the loop trigger arrangement of the Rising patent issued May 16, 1916, U.S. Pat. No. 1,183,115, and by Artamendi of Barcelona, Spain, in his American U.S. Pat. No. 1,416,671, issued May 23, 1922, the latter being a safety for magazine withdrawal in a completely restructured semiautomatic handgun.

Some of the later weapons had the safety devices as a part of the manufacturing process. Examples include the "Automatic Loading Firearm" of the A. Obregon patent dated Apr. 26, 1958, U.S. Pat. No. 2,115,041, a lever safety device; and the Thomas "Semi-Automatic Firearm," of U.S. Pat. No. 3,857,325, dated Dec. 31, 1974, showing a magazine removal safety bar.

Further developments in safety devices featuring removal and insertion of the magazine are seen in the rod activated safety of Tansley, U.S. Pat. No. 1,638,068, Aug. 9, 1927; the plunger device of Roper, U.S. Pat. No. 2,372,519, dated Mar. 27, 1945, and in U.S. Pat. No. 4,428,138, issued Jan. 31, 1984, to Sceecamp, a spring mechanism to block trigger action.

The foregoing patents are presented as representative of the developing art in trigger deactivating safety devices most incorporating removal and insertion of the magazine from an semiautomatic handgun. As described hereinafter, the safety catch of the present invention uses simple mechanics that improves its effectiveness over those disclosed in the past art patents.

SUMMARY OF THE INVENTION

To provide an improved magazine gun lock safety, in practicing my invention, I use a rectangular safety catch with a right angled OFF activating lever affixed on one side. When the magazine is removed from the gun chamber, the safety catch is pivotal and angles over pushed by a bias spring so the OFF lever protrudes into the chamber through an aperture at one side. In this position, the safety is ON and interferers with the hammer spring guide. This prevents the gun hammer spring from activating the trigger-hammer mechanism immobilizing the hammer and preventing the gun from being fired. With the safety catch of the immediate invention in the ON position, should a live cartridge have remained undetected in the firing chamber, the gun cannot be fired accidentally. When the magazine is pushed back into the handgun magazine chamber, it forces the OFF activating lever back out of the handgun magazine chamber and the safety catch is in the OFF position releasing the hammer spring guide. The trigger-hammer mechanism is then operational and the gun can be fired.

Therefore, a principal object of the present invention is to provide a gun safety device particularly for a semiautomatic handgun which deactivates the trigger mechanism so the gun cannot be fired should a live bullet have remained in the firing chamber when the magazine is removed.

A further object of this invention is to provide an uncomplicated handgun safety device effecting the gun hammer spring guide with the safety being ON when the gun magazine is removed and returned to OFF when the magazine is fully inserted into the gun magazine chamber.

A still further object of the invention is to provide a semiautomatic handgun safety effecting the gun hammer spring guide that requires only minimal changes in the existing gun design to added the safety device to the gun structure.

Another object of the present invention is to provide a gun magazine chamber safety embodied in a one-piece, spring activated device that does not require complicated mechanics and additional functional parts to be fully operational.

Other objects and the many advantages of the present invention will become clear from reading the specification and comparing numerically designated parts described relative to the same numbered parts illustrated in the drawings.

DESCRIPTION OF THE PREFERRED EMBODIMENTS

Figure 1:
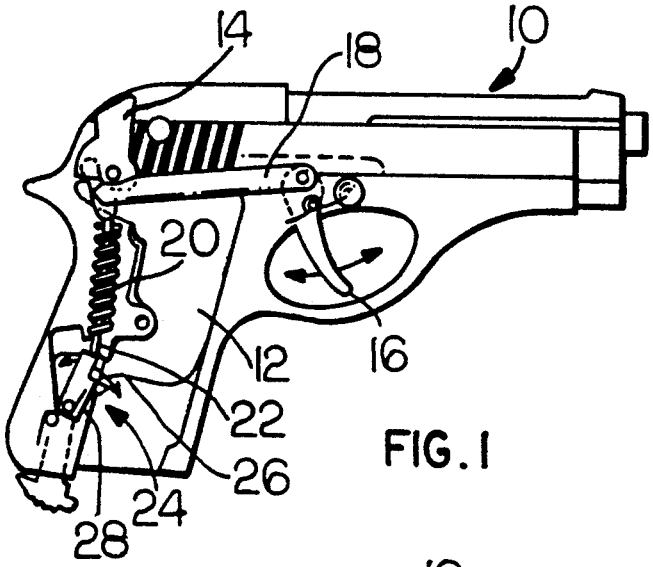
FIG. 1 shows a side elevation view of a handgun with the outer casing removed and the magazine gun lock safety according to the invention installed. The internal trigger mechanism and the safety catch of this invention is visible. In this illustration, the magazine of the gun is removed, the safety catch pushed by a biasing spring is angled over with the OFF activating lever protruding through an opening into the magazine chamber, and the safety is in the ON position.
Figure 3:
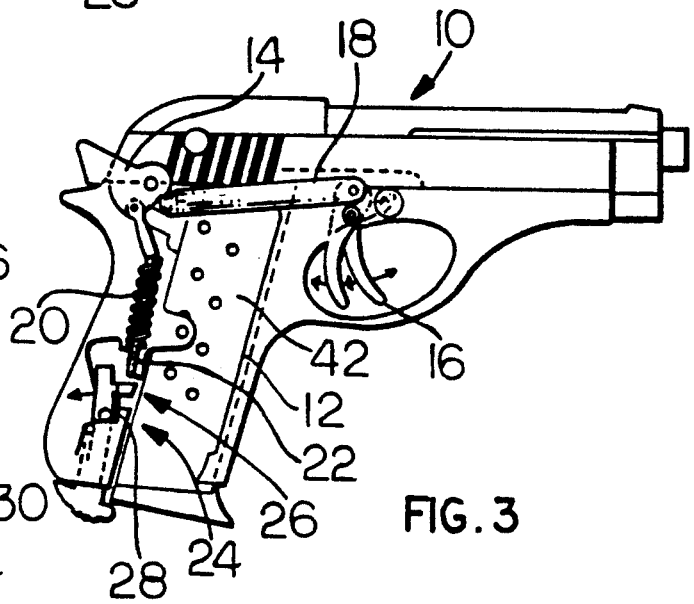
FIG. 3 shows the same side elevation view of a handgun as FIG. 1 with the outer casing removed. The safety catch in this illustration has been levered back into the OFF position by insertion of the gun magazine.

Referring now to the drawings and to FIG. 1. where magazine 42 (FIG. 3) has been removed from magazine chamber 12 of a semiautomatic handgun 10. The particularly structured, one-piece safety catch 28 of this invention is angled over with OFF activating lever 30 protruding into magazine chamber 12 through safety catch compartment to magazine chamber opening 26 having been moved to this position by ON biasing spring 32. Safety catch 28, as illustrated in FIG. 1, is in the ON position with the top flat portion of safety catch 28 pressed against hammer spring guide 22. This prevents hammer spring 20 from activating trigger-hammer mechanism 18 immobilizing hammer 14 and handgun 10 can not be fired if an undetected live cartridge remains in the gun firing chamber. When magazine 42 is pushed back into handgun magazine chamber 12, shown in FIG. 3, it forces OFF activating lever 30 back out of handgun magazine chamber 12 and safety catch 28 is in the OFF position releasing hammer spring guide 22. Trigger-hammer mechanism 18 is operational and gun 10 can be fired.

Figure 2:
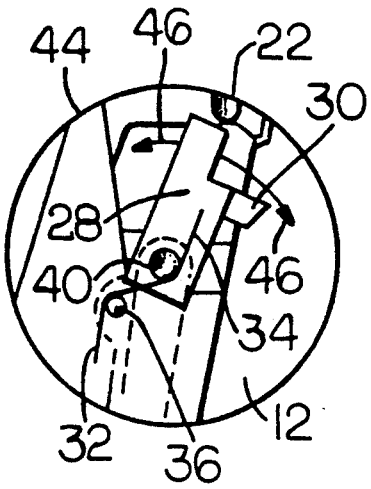
FIG. 2 shows an enlargement of the safety catch area of FIG. 1 further illustrating the safety catch in the ON position being angled over with the OFF activating lever passed through the opening in the wall of the empty magazine chamber by the force of a biasing spring.
Figure 4:
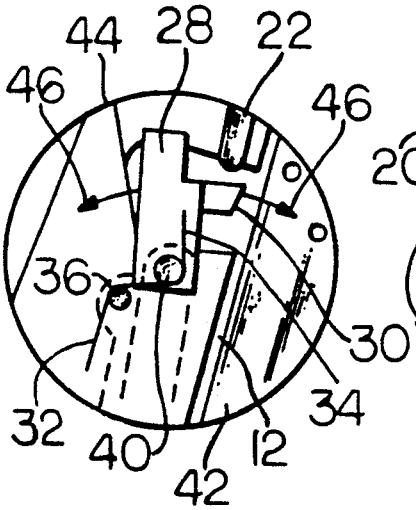
FIG. 4 shows an enlarged view of the FIG. 3 safety catch area further illustrating the safety catch of this invention in the OFF position.
Figure 5:
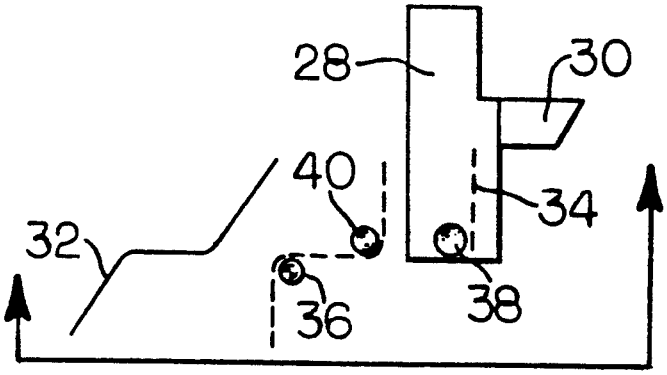
FIG. 5 shows the separated operational parts of the magazine gun lock safety according to the invention.

The ON and OFF positioning of safety catch 28 is best illustrated in the safety catch compartment enlargements 44 in FIG. 2, showing ON and in FIG. 4 showing OFF. FIG. 5 shows operational parts of the present invention including ON biasing spring 32, spring stud 36, safety catch axle stud 40, safety catch 28, safety catch axle receiving shaft 38, spring keeper 34, and OFF activating lever 30. It is noted that ON biasing spring 32, shown as a bent spring could also be a looped spring.

The operation of the magazine gun lock safety according to the invention is uniquely simple. When magazine 42 is in gun magazine chamber 12 of semiautomatic handgun 10 (FIG. 3), the hammer-facing edge of magazine 42 presses against OFF activating lever 30 keeping safety catch 28 upright clear of interference with hammer spring guide 22. Hammer spring 20 is operational as is trigger-hammer mechanism 18 and hammer 14 will operate when trigger 16 is pulled. Conversely, as illustrated in FIG. 1 and in the FIG. 2 enlargement of safety catch compartment 24, when magazine 42 is removed from magazine chamber 12 of semiautomatic handgun 10, the edge pressure on OFF activating lever 30 is removed and safety compartment to magazine chamber opening 26 is open. Pressured by ON biasing spring 32, safety catch 28 angles over pivoted on safety catch axle stud 40 through safety catch axle receiving shaft 38 and OFF activating lever 30 extends out into the empty magazine chamber 12 through opening 26. In this position, the top surface of safety catch 28 moves under hammer spring guide 22 preventing hammer spring 20 from being operational and the magazine gun lock safety constituting the present invention is ON.

Although I have described embodiments of my invention with considerable detail in the foregoing specification and have illustrated them extensively in the drawings, it is to be understood that I may practice variations in the invention which do not exceed the scope of the appended claims. Also, any variations of my invention practiced by others which fall within the scope of my claims, I shall consider to be my invention.

What is claimed is:

1. An improved magazine gun lock safety for semiautomatic handguns having a hammer spring guide including in combination:

a. a substantially rectangular safety catch vertically elongated having an upper flat end and a lower flat end, said upper flat end being narrowed by an upwardly positioned right angle cut affixed thereat with a horizontally inclined stub-like lever, said lever having a terminal end somewhat angled outwardly from a lower horizontal edge to an upper horizontal edge, said lever designated an OFF activating lever;

b. said safety catch having an axle receiving shaft opened centrally therethrough adjacent said lower flat end fitting an axle stud attached inside a handgun handle housing providing said safety catch attachment thereto with limited pivotal mobility;

c. a biasing spring affixed in said semiautomatic handgun handle in a manner to pressure said safety catch angled so a substantial end portion of said OFF activating lever can pass through an opening in the magazine chamber of said semiautomatic handgun handle, said opening sized and in proper alignment to receive said substantial end portion of said OFF activating lever allowing passage therethrough when the cartridge magazine of said handgun is removed placing said safety catch in ON condition;

d. said upper flat end of said safety catch positioned to interfere with the hammer spring guide of said semiautomatic handgun when said safety catch is in said ON condition preventing said handgun hammer spring being operable and disabling the trigger-hammer mechanism of said handgun so said handgun can not be fired when said safety catch is in said ON condition;

e. said OFF activating lever returning said safety catch to an OFF condition when pressed back towards said magazine chamber wall opening by reinsertion of said magazine into said magazine chamber of said handgun relieving said interference with said hammer spring guide enabling said trigger-hammer mechanism so said handgun can be fired.

2. The improved magazine gun lock safety for semiautomatic handguns of claim 1 wherein said biasing spring is a flat spring affixed to said safety catch by a spring keeper grove with said spring angled around said safety catch axle stud to a bent and retained position around a spring stud in a manner to exert a desired force for angling said safety catch towards said handgun magazine chamber.

3. The improved magazine gun lock safety for semiautomatic handguns of claim 1 wherein said biasing spring is provided with a loop for better attachment to said safety catch axle stud.

4. The improved magazine gun lock safety for semiautomatic handguns of claim 1 wherein said safety catch and operational parts therefore are positioned in a safety catch compartment in said handle of said semiautomatic handgun.

* * * * *